US005127118A

United States Patent [19]

Johenning

[11] Patent Number: 5,127,118

[45] Date of Patent: Jul. 7, 1992

[54] WATERBED HOSE CONNECTOR

[75] Inventor: John B. Johenning, Beverly Hills, Calif.

[73] Assignee: Strata Flotation, Inc., Torrance, Calif.

[21] Appl. No.: 746,040

[22] Filed: Aug. 16, 1991

[51] Int. Cl.[5] ..... A47C 27/08

[52] U.S. Cl. ..... 5/451; 5/658; 141/285; 141/302; 141/382

[58] Field of Search ..... 5/451, 449, 450, 452, 5/453, 455, 658; 141/382, 205, 302

[56] References Cited

U.S. PATENT DOCUMENTS

| | | | |
|---|---|---|---|
| 560,070 | 5/1896 | Staub et al. | 141/382 |
| 2,319,567 | 5/1943 | Vegell | 141/285 |
| 3,118,474 | 1/1964 | Eppolito | 141/285 |
| 3,133,696 | 5/1964 | Mirando | 5/454 |
| 3,187,936 | 6/1965 | Downing | 141/285 |
| 3,797,538 | 3/1974 | Mollura | 141/382 |
| 4,316,489 | 2/1982 | Price | 5/451 |
| 4,386,638 | 6/1983 | Hall et al. | 141/382 |
| 5,090,075 | 2/1992 | Larson | 5/451 |

FOREIGN PATENT DOCUMENTS

| | | | |
|---|---|---|---|
| 5061 | 11/1931 | Australia | 141/285 |
| 1134566 | 4/1957 | France | 141/285 |
| 211813 | 2/1924 | United Kingdom | 141/285 |

*Primary Examiner*—Alexander Grosz

*Attorney, Agent, or Firm*—Flehr, Hohbach, Test, Albritton & Herbert

[57] ABSTRACT

Hose connector for use in filling and/or draining a waterbed mattress. The connector has a body with water and air passageways formed therein adapted to be mounted in the fill/drain opening of the mattress. The water passageway carries water between a hose connected to the connector and the interior of the mattress, and the air passageway permits trapped air to escape from the mattress while the mattress is being filled with water. A closure is provided for closing the air passageway when the mattress is in use and when it is being drained, and in some embodiments a water responsive valve closes the air passageway in the event that water enters the air passageway while the mattress is being filled.

17 Claims, 1 Drawing Sheet

WATERBED HOSE CONNECTOR

This invention pertains generally to waterbeds and, more particularly, to a hose connector for use in filling and/or draining a waterbed mattress Waterbeds are commonly filled through a garden hose or the like connected to a so-called valve provided in the mattress. In order to remove trapped air from the mattress, it is necessary to interrupt the filling process, disconnect the hose, and work the air out through the valve without spilling the water.

U.S. Pat. No. 4,212,335 discloses a waterbed filling unit having a tapered water delivery tube with a nut for retaining the tube in the filler neck or valve while the mattress is filled with water. There is no provision, however, for removing trapped air, and it is necessary to disconnect the unit to remove the air.

It is in general an object of the invention to provide a new and improved hose connector for filling waterbeds.

Another object of the invention is to provide a hose connector of the above character which overcomes the limitations and disadvantages of waterbed filling units heretofore provided.

These and other objects are achieved in accordance with the invention by providing a connector for use in filling and/or draining a waterbed having a body adapted to be received in sealing relationship within a fill/drain opening in the mattress with first and second end portions of the body positioned respectively outside and inside the mattress, means for connecting the first end portion to a hose, a water passageway extending between the first and second end portions for carrying water between the hose and the mattress, and an air passageway extending between the second end portion and a portion of the body outside the mattress for removing air from the mattress. Means is provided for closing the air passageway when the mattress is in use and when it is being drained, and in some embodiments a water responsive valve closes the air passageway in the event that water enters the air passageway while the mattress is being filled.

Figure 1:
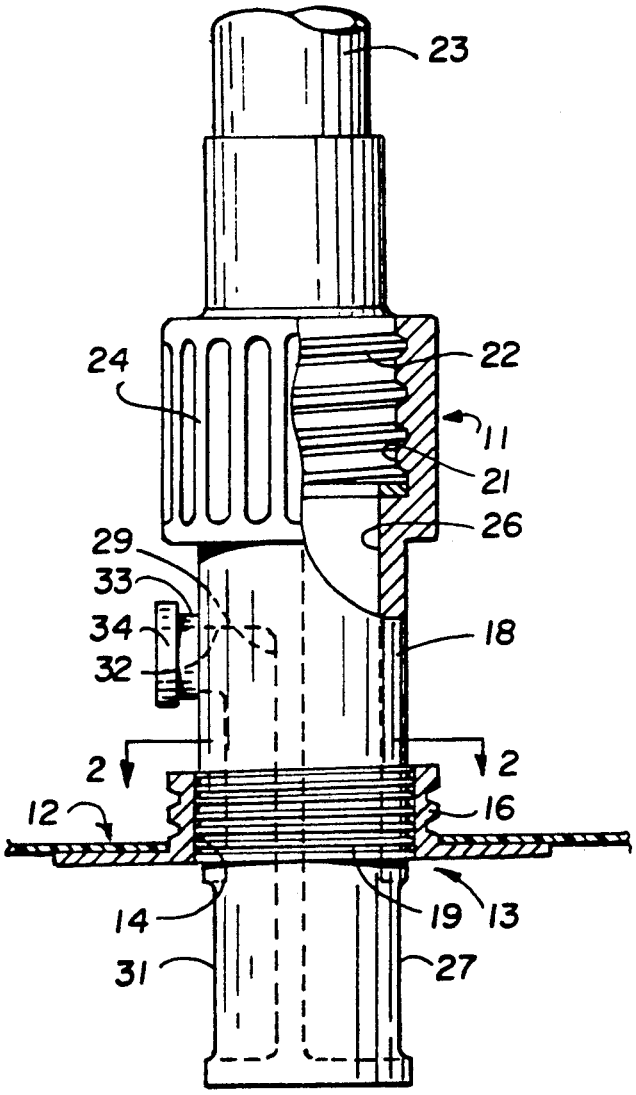
FIG. 1 is a side elevational view, partly broken away, of one embodiment of a hose connector incorporating the invention installed in the fill/drain valve opening of a waterbed mattress.
Figure 2:
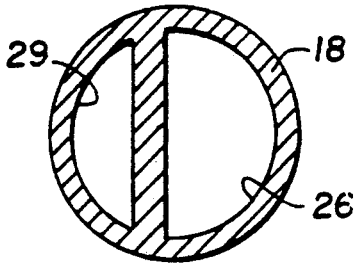
FIG. 2 is a cross-sectional view taken along line 2-2 in FIG. 1.

In FIG. 1, the hose connector 11 is illustrated in connection with a waterbed mattress 12 of conventional design having a valve 13 with an opening 14 through which water is introduced into and removed from the mattress. The valve has a relatively short, externally threaded cylindrical neck 16 on which a cap (not shown) is mounted to close the valve and seal the opening once the mattress has been filled with water.

The connector has an elongated cylindrical body 18 with a diameter corresponding to that of opening 14. The body is fabricated of a suitable material such as plastic and has a series of peripheral ribs 19 midway between its two ends for gripping engagement with the inner surface of neck 16 to secure the connector in the valve and provide a fluid-tight seal between the connector and the mattress.

The upper end of the cylindrical body is provided with a female hose thread 21 for engagement with the male thread 22 at the distal end of a garden hose 23. The upper end portion of the body is enlarged and formed with a fluted or ribbed outer surface 24 to facilitate connection and disconnection of the hose.

A water passageway 26 extends longitudinally within the connector body and opens through the upper end of the body in communication with the hose. The lower end of passageway 26 communicates with the interior of the mattress through an outlet opening 27 which opens through the side wall of the body toward the lower end thereof.

An air passageway 29 also extends longitudinally within the connector body beside the water passageway, with an inlet opening 31 in the lower portion of the side wall and an outlet 32 toward the upper end of the wall. The outlet has a cylindrical hub 33 with a removable closure 34 such as a cap or a plug.

In the embodiment illustrated, the water passageway and the air passageway each have a generally semi-circular shape in cross-section. However, they may have any other desired cross-sectional configuration, e.g. round, and they may be positioned concentrically of each other rather than being side-by-side.

In operation and use, the connector is attached to the hose and pushed into valve opening 14 until ribs 19 engage the wall of the opening and water outlet 27 and air inlet 31 are inside the mattress. To fill the mattress, the closure is removed from the outlet of the air passageway, and water is supplied to the mattress through the hose and passageway 26. As the mattress fills with water, trapped, air is vented or bled out through passageway 29 without any interruption of the filling process.

To drain the mattress, air passageway 29 is closed with cap 34, and hose 23 is connected to a pump which draws the water out of the mattress.

Figure 3:
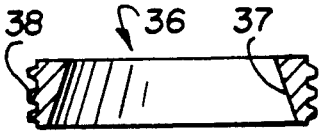
FIG. 3 is a cross-sectional view of a lock ring for use with the embodiment of FIG. 1.

FIG. 3 illustrates a lock ring 36 which can be used to secure the connector in the drain/fill valve. The lock ring has a tapered inner wall surface 37 and a plurality of peripheral ribs 38. With the connector body positioned in the valve opening, the lock ring is slipped over the connector and pressed onto the valve so that the tapered wall surface of the ring bears against the outer portion of the threaded valve neck with a wedging action which presses the valve neck against the connector, thereby locking the connector in place and assuring a fluid-tight seal between the connector and the mattress. The ribs on the outer periphery of the lock ring facilitate gripping of the lock ring with the fingers as it is pressed onto and removed from the valve.

Figure 4:
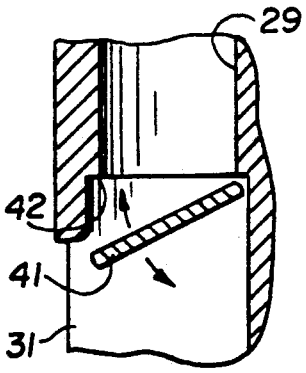
FIG. 4 is an enlarged fragmentary sectional view of another embodiment of a hose connector incorporating the invention.

As illustrated in FIG. 4, air passageway 29 can be provided with a liquid responsive valve which closes off the passageway in the event that water should enter it during a filling operation. In the embodiment illustrated, the liquid responsive valve comprises a buoyant valve member 41 which is hingedly attached to the connector body and adapted to seat against a valve seat 42 in the passageway. The shape of the valve member corresponds to the cross-section of the air passageway, which in this particular example is semicircular. The valve can be of any suitable type, and with a circular passageway, the valve member can, for example, be a floating ball.

The flow of air out of the mattress is not sufficient to move the valve member to the seat, and as long as water does not enter the air passageway, the valve remains open to pass the air. In the event that water does enter the air passageway, the valve will close, preventing the water from flowing out the air passageway.

The invention has a number of important features and advantages. It permits a waterbed mattress to be filled and drained easily, with trapped air being removed automatically without interrupting the filling process.

It is apparent from the foregoing that a new and improved waterbed hose connector has been provided. While only certain presently preferred embodiments have been described in detail, as will be apparent to those familiar with the art, certain changes and modifications can be made without departing from the scope of the invention as defined by the following claims.

I claim:

1. In combination: a waterbed mattress having a fill/-drain opening, a cylindrical body removably inserted in the opening with a first end of the body positioned outside the mattress and a second end of the body positioned inside the mattress, a lock ring positioned between the ends of the body securing the body in the opening, a thread at the first end of the body for connection to a hose, a water passageway in the body for carrying water between the hose and the interior of the mattress, and a separate air passageway in the body for carrying air out of the mattress.

2. The combination of claim 1 wherein the lock ring has a tapered surface which provides a wedging action for holding the connector in the fill/drain opening.

3. The combination of claim 1 including means for closing the air passageway when water is being removed from the mattress.

4. The combination of claim 1 including means responsive to water int he air passageway for closing the air passageway to prevent water from passing through the air passageway.

5. The combination of claim 1 wherein the water passageway opens through the first end and a side wall of the cylindrical body.

6. The combination of claim 1 wherein the air passageway opens through a side wall of the cylindrical body on opposite sides of the lock ring.

7. In combination: a waterbed mattress having a fill/-drain valve with an opening, a cylindrical body removably inserted in the opening with a first end of the body positioned outside the mattress and a second end of the body positioned inside the mattress, a lock ring positioned between the ends of the body and having a tapered inner surface in wedging engagement with the fill/drain valve to secure the body in the opening, a thread at the first end of the body for connection to a hose, a water passageway opening through the first end and the side wall of the body for carrying water between the hose and the interior of the mattress, and a separate air passageway opening through portions of the side wall on opposite sides of the lock ring for carrying air out of the mattress.

8. The combination of claim 7 including means responsive to water in the air passageway for closing the air passageway to prevent water from passing through the air passageway.

9. In combination: a waterbed mattress having a fill/-drain opening, a cylindrical body in sealing relationship with the opening with a first and second end portions of the body positioned respectively outside and inside the mattress, a hose connected to the first end portion, a water passageway extending between the first and second end portions for carrying water between the hose and the interior of the mattress, and a separate air passageway extending between the second end portion and a portion of the body outside the mattress for removing air from the mattress.

10. The combination of claim 9 wherein the body has a plurality of peripheral ribs intermediate the two end portions in gripping engagement with a wall of the fill/drain opening.

11. The combination of claim 9 including a lock ring which slides over the cylindrical body and engages the mattress to retain the cylindrical body in the fill/drain opening.

12. The combination of claim 11 wherein the mattress has a valve with a cylindrical neck portion in which the fill/drain opening is formed, and the lock ring has a tapered inner surface adapted to engage the neck portion of the valve with a wedging action which presses the neck portion against the cylindrical body.

13. The combination of claim 9 including means for closing the air passageway when water is being removed from the mattress.

14. The combination of claim 9 including means responsive to water in the air passageway for closing the air passageway to prevent water from passing through the air passageway.

15. In a method of filling a waterbed mattress, the steps of: inserting a connector into an opening in the mattress, introducing water into the mattress through a first passageway in the connector, and removing air from the mattress through a second passageway in the connector.

16. The method of claim 15 wherein air is removed through the second passageway at the same time that water is being introduced through the first passageway.

17. The method of claim 15 including the step of closing off the second passageway in response to water entering that passageway.

* * * * *